US006505429B2

(12) United States Patent
Percival

(10) Patent No.: US 6,505,429 B2
(45) Date of Patent: Jan. 14, 2003

(54) PORTABLE FIREARM RESTING ASSEMBLY

(76) Inventor: Curran John Percival, 11551 Caminito Rio, Lakeside, CA (US) 92040

( * ) Notice: Subject to any disclaimer, the term of this patent is extended or adjusted under 35 U.S.C. 154(b) by 0 days.

(21) Appl. No.: 09/747,890

(22) Filed: Dec. 26, 2000

(65) Prior Publication Data

US 2002/0078617 A1 Jun. 27, 2002

(51) Int. Cl.[7] ..... F41A 23/12; F41A 23/14; F16M 11/20; F16M 11/38

(52) U.S. Cl. ..... 42/94; 89/37.04; 248/163.1; 248/163.2; 248/164; 248/166

(58) Field of Search ..... 42/94; 248/163.1, 248/163.2, 164, 166; D16/244; 89/37.04

(56) References Cited

U.S. PATENT DOCUMENTS

| | | | | | |
|---|---|---|---|---|---|
| 659,035 | A | * | 10/1900 | Messing | 182/225 |
| 1,000,284 | A | * | 8/1911 | Moore | 248/164 |
| 1,073,531 | A | * | 9/1913 | Schneider | 211/203 |
| 1,355,660 | A | * | 10/1920 | Farquhar | 42/94 |
| 1,524,973 | A | * | 2/1925 | Hazelton | 42/94 |
| 1,801,087 | A | * | 4/1931 | Johnson | 248/164 |
| 1,845,921 | A | * | 2/1932 | Karwoski | 248/155.1 |
| 2,569,435 | A | * | 9/1951 | Martin | 42/94 |
| 3,016,802 | A | * | 1/1962 | Grunenberg | 42/94 |
| 3,703,046 | A | * | 11/1972 | Barone | 42/94 |
| 4,000,769 | A | * | 1/1977 | Katz | 206/316.1 |
| 4,266,748 | A | * | 5/1981 | Dalton | 248/425 |
| D290,963 | S | * | 7/1987 | Groschupp | D16/244 |
| 4,967,497 | A | * | 11/1990 | Yakscoe | 42/94 |
| 5,406,732 | A | * | 4/1995 | Peterson | 42/94 |
| 5,876,091 | A | * | 3/1999 | Chernomashentsev | 248/431 |
| 5,930,933 | A | * | 8/1999 | Schleicher | 42/94 |

* cited by examiner

*Primary Examiner*—Charles T. Jordan
*Assistant Examiner*—Tara M Golba

(57) ABSTRACT

A portable firearm resting assembly for providing an easily carried and set up tripod rest for holding a firearm when the firearm is not in use. The portable firearm resting assembly includes a tripod assembly having a pair of main legs, a support leg, and a carrying case for storage of the tripod assembly. In an embodiment, the support leg is shorter than the main legs and a cord is provided for holding the main legs in a spread position during use.

9 Claims, 1 Drawing Sheet

PORTABLE FIREARM RESTING ASSEMBLY

BACKGROUND OF THE INVENTION

1. Field of the Invention

The present invention relates to firearm rests and stands and more particularly pertains to a new portable firearm resting assembly for providing an easily carried and set up tripod rest for holding a firearm when the firearm is not in use.

2. Description of the Prior Art

The use of firearm rests and stands is known in the prior art. More specifically, firearm rests and stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,016,802; 3,703,046; 1,355,660; 2,569,435; 1,524,973; and U.S. Pat. No. Des. 290,963.

While these devices fulfill their respective, particular objectives and requirements, the aforementioned patents do not disclose a new portable firearm resting assembly for holding a firearm while the firearm is not being used. The inventive device includes a tripod assembly having a pair of main legs and a shorter support leg, a cord for holding the main legs in a spread position during use, and a carrying case for storage of the tripod assembly.

In these respects, the portable firearm resting assembly according to the present invention substantially departs from the conventional concepts and designs of the prior art, and in so doing provides an apparatus primarily developed for the purpose of providing an easily carried and set up tripod rest for holding a firearm when the firearm is not in use.

SUMMARY OF THE INVENTION

In view of the foregoing disadvantages inherent in the known types of firearm rests and stands now present in the prior art, the present invention provides a new portable firearm resting assembly construction wherein the same can be utilized for providing an easily carried and set up tripod rest for holding a firearm when the firearm is not in use.

The general purpose of the present invention, which will be described subsequently in greater detail, is to provide a new portable firearm resting assembly apparatus and method which has many of the advantages of the firearm rests and stands mentioned heretofore and many novel features that result in a new portable firearm resting assembly which is not anticipated, rendered obvious, suggested, or even implied by any of the prior art firearm rests and stands, either alone or in any combination thereof.

To attain this, the present invention generally comprises a tripod assembly having a pair of main legs and a shorter support leg, a cord for holding the main legs in a spread position during use, and a carrying case for storage of the tripod assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable firearm resting assembly apparatus and method which has many of the advantages of the firearm rests and stands mentioned heretofore and many novel features that result in a new portable firearm resting assembly which is not anticipated, rendered obvious, suggested, or even implied by any of the prior art firearm rests and stands, either alone or in any combination thereof.

It is another object of the present invention to provide a new portable firearm resting assembly that may be easily and efficiently manufactured and marketed.

It is a further object of the present invention to provide a new portable firearm resting assembly that is of a durable and reliable construction.

An even further object of the present invention is to provide a new portable firearm resting assembly which is susceptible of a low cost of manufacture with regard to both materials and labor, and which accordingly is then susceptible of low prices of sale to the consuming public, thereby making such portable firearm resting assembly economically available to the buying public.

Still yet another object of the present invention is to provide a new portable firearm resting assembly which provides in the apparatuses and methods of the prior art some of the advantages thereof, while simultaneously overcoming some of the disadvantages normally associated therewith.

Still another object of the present invention is to provide a new portable firearm resting assembly for providing an easily carried and set up tripod rest for holding a firearm when the firearm is not in use.

Yet another object of the present invention is to provide a new portable firearm resting assembly which includes a tripod assembly having a pair of main legs and a shorter support leg, a cord for holding the main legs in a spread position during use, and a carrying case for storage of the tripod assembly.

Still yet another object of the present invention is to provide a new portable firearm resting assembly that is lightweight for facilitating carrying while hunting.

Even still another object of the present invention is to provide a new portable firearm resting assembly that protects a firearm in the field by preventing placing of the firearm directly on the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
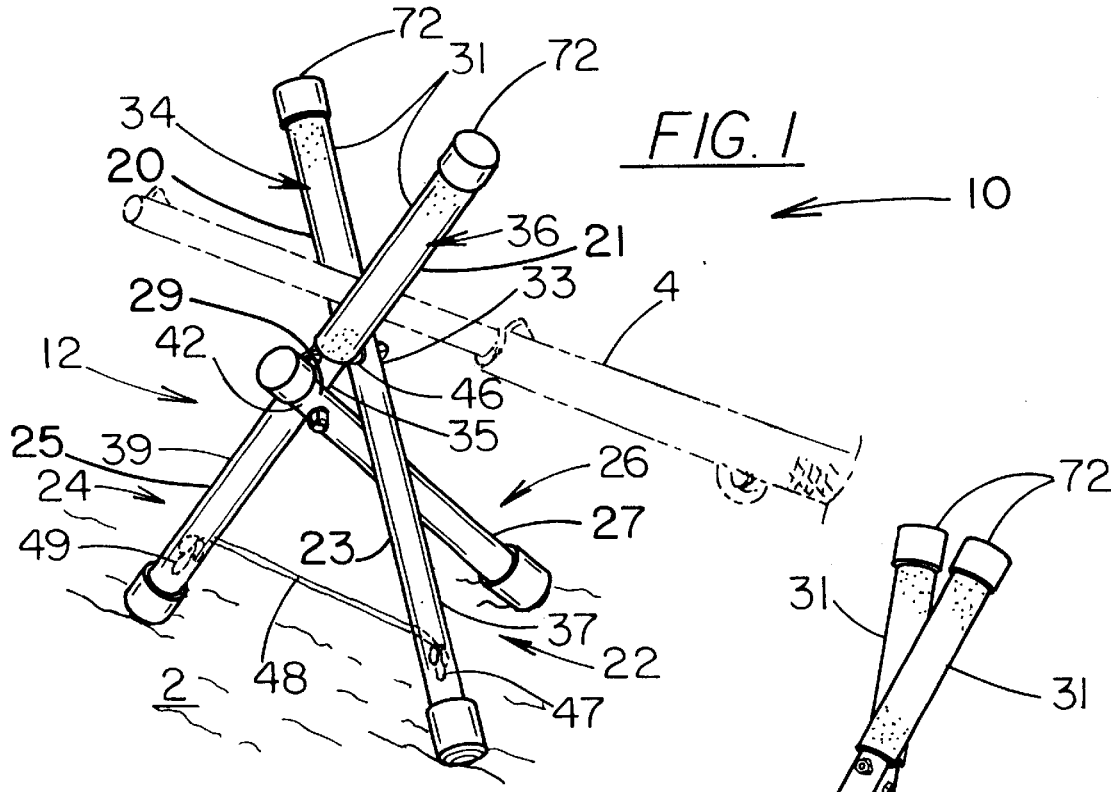
FIG. 1 is a perspective view of a new portable firearm resting assembly according to the present invention.
Figure 2:
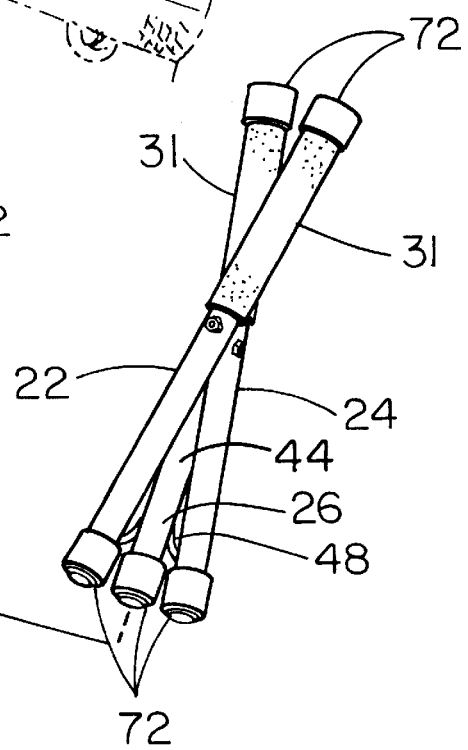
FIG. 2 is an exploded view of the invention in a storage position.
Figure 2:
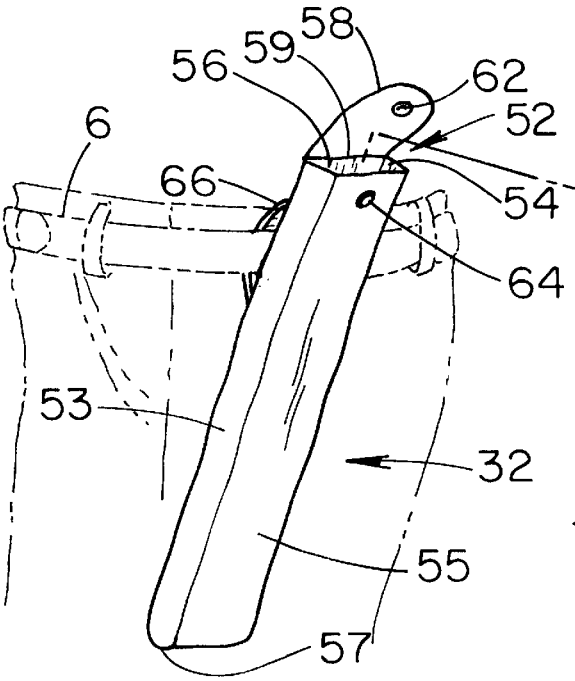

With reference now to the drawings, and in particular to FIGS. 1 and 2 thereof, a new portable firearm resting assembly embodying the principles and concepts of the present invention and generally designated by the reference numeral 10 will be described.

As best illustrated in FIGS. 1 and 2, the portable firearm resting assembly 10 generally comprises a tripod assembly 12 that includes a pair of main legs 22 and 24 and a support leg 26. The main legs 22 and 24 are pivotally coupled to each other such that lower ends 23 and 25 of main legs 22 and 24, respectively, are positionable in spaced relationship to each other when the main legs 22 and 24 are in a spread position.

The support leg 26 is pivotally coupled to the main legs 22 and 24 such that a lower end 27 of the support leg is positionable in spaced relationship to the lower ends 23 and 25 of the main legs 22 and 24 when the main legs 22 and 24 are in the spread position. Thus, the tripod assembly 12 is designed for resting on a support surface 2.

A carrying case 32 is provided for holding the tripod assembly 12 when the tripod assembly 12 is in a closed position. The closed position is defined by the main legs 22 and 24 and the support leg 26 being pivoted such that the lower ends 23 and 25 of the main legs and the lower end 27 of the support leg are positioned adjacent to each other.

In an embodiment, the main legs 22 and 24 are pivotally coupled together at a medial portion 33 and 35 of each of the main legs 22 and 24, respectively. Each main leg 22 and 24 also includes an upper portion 34 and 36 extending upwardly away from the medial portion 33 and 35 and a lower portion 37 and 39 extending downwardly away from the medial portion 33 and 35.

The upper portions 34 and 36 are each covered by a cushioning material 31. Thus each of the upper portions 34 and 36 is designed for preventing damage to a firearm 4 resting on the upper portions 34 and 36.

A top portion 42 of the support leg 26 is pivotally coupled to either one of the main legs 22 and 24 (24 as shown in the drawing figures). The support leg includes a lower portion 44 extending downwardly from the top portion 42 of the support leg 26. The lower portion is pivoted to extend just below a crux 46 formed between the pivoted main legs 22 and 24. Thus, the crux 46 rests against the support leg 26 when the tripod assembly 12 is in the open position.

A flexible line 48 is provided and includes a first end 47 coupled to the lower portion 37 of one of the main legs 22 and a second end 49 coupled to the lower portion 39 of main leg 24 such that the flexible line 48 extends between the lower portions 37 and 39 of the main legs 22 and 24 for preventing the lower ends 23 and 25 from spreading apart beyond a predetermined distance.

The carrying case 32 is generally rectangular and includes an open top end 52, an elongated pair of sides 53 and 54, an elongated front 55, an elongated back 56, and a closed bottom end 57.

The carrying case 32 also includes a flap 58 extending from a back edge 59 of the open top end. The flap 58 is designed for extending over the open top end 52 for covering the open top end 52. The flap 58 includes a first connection member 62 coupled to an interior face of the flap 58. A second connection member 64 is coupled to an outer face of the elongated front 55 of the carrying case 32. The second connection member 64 is complimentary to the first connection member 62 whereby the first connection member 62 is selectively engageable to the second connection member 64. Thus, the flap 58 is held in a covering position over the open top end 52 to define a closed position of the carrying case 32.

In an embodiment, a loop member 66 is coupled to an exterior face of the elongated back 56. The loop member 66 is designed for receiving a belt 6 therethrough such that the carrying case 32 is designed for coupling to the belt 6 of a user.

A plurality of end caps 72 are provided for preventing debris from entering the main and support legs 22, 24, and 26. End caps 72 positioned on the lower ends of each of the main and support legs are further provided for promoting stable gripping relative to the support surface 2. End caps 72 are positioned over an associated one of the main leg lower ends 23 and 25, the support leg lower end 27, the main leg upper ends 20 and 21, and the support leg upper end 29.

In use, the tripod assembly is removed from the carrying case. The lower ends of the main legs are spread sufficiently to permit the support leg to be pivoted such that the lower portion of the support leg passes between the main legs. The main legs are then fully spread until the flexible line is fully extended between the main legs. The opened tripod assembly is then placed on the ground or other support surface. A firearm may then be placed or propped between the cushioned top portions of the main legs. Thus the full length of the firearm is prevented from lying directly against the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm resting assembly comprising:

a tripod assembly having a pair of main legs and a support leg, said main legs being pivotally coupled to each other such that lower ends of each main leg are positionable in spaced relationship to each other when said main legs are in a spread position;

said support leg being pivotally coupled to said main legs such that a lower end of said support leg is positionable in spaced relationship to said lower ends of said main legs when said main legs are in said spread position wherein said tripod assembly is adapted for resting on a support surface;

said main legs being pivotally coupled together at a medial portion of each of said main legs, each main leg having an upper portion extending upwardly away from said medial portion such that said upper portions of said main legs form a generally V-shaped cradle portion when said main legs are in said spread position wherein said main legs are adapted for receiving and supporting a firearm between said upper portions of said main legs, each of said main legs further having a lower portion extending downwardly away from said medial portion; and a top portion of said support leg being pivotally coupled to one of said main legs at a position proximate a distal end of said support leg and below said medial portion where said main legs are pivotally coupled such that said distal end of said top portion is positionable horizontally below said cradle portion formed by said upper portions of said main legs when said main legs are in said spread position wherein said distal end is adapted for minimizing contact with the firearm when the firearm is supported in said cradle, said support leg having a lower portion extending downwardly from said top portion of said support leg.

2. The firearm resting assembly of claim 1, further comprising:

said upper portion of each main leg being covered by a cushioning material wherein each of said upper portions is adapted for preventing damage to the firearm supported by said cradle portion.

3. The firearm resting assembly of claim 1, further comprising:

a flexible line having a first end coupled to said lower portion of one of said main legs and a second end coupled to said lower portion of another of said main legs such that said flexible line extends between the lower portions of said main legs for preventing said lower ends of said main legs from spreading apart beyond a predetermined distance.

4. The firearm resting assembly of claim 1, further comprising:

a carrying case for holding said tripod assembly when said tripod assembly is in a closed position, said closed position being defined by said main legs and said support leg being pivoted such that said lower ends of said main legs and said lower end of said support leg are positioned adjacent to each other;

said carrying case being generally rectangular having an open top end, an elongated pair of sides, an elongated front, an elongated back, and a closed bottom end; and said carrying case including a flap extending from a back edge of said open top end, said flap being for extending over said open top end for covering said open top end.

5. The firearm resting assembly of claim 4, further comprising:

said flap including a first connection member coupled to an interior face of said flap;

a second connection member coupled to an outer face of said elongated front of said carrying case, said second connection member being complimentary to said first connection member wherein said first connection member is selectively engageable to said second connection member wherein said flap is held in a covering position over said open top end to define a closed position of said carrying case.

6. The firearm resting assembly of claim 4, further comprising:

a loop member coupled to an exterior face of said elongated back, said loop member being adapted for receiving a belt therethrough wherein said carrying case is adapted for coupling to a belt of a user.

7. The firearm resting assembly of claim 1, further comprising:

a plurality of end caps, each end cap being positioned over an associated one of said main leg lower ends and said support leg lower end.

8. The firearm resting assembly of claim 1, further comprising:

said support leg having an upper end;

each of said main legs having an upper end; and a plurality of end caps, each end cap being positioned over an associated one of said main leg lower ends, said support leg lower end, said main leg upper ends, and said support leg upper end.

9. A firearm resting assembly comprising:

a tripod assembly having a pair of main legs and a support leg, said main legs being pivotally coupled to each other such that lower ends of each main leg are positionable in spaced relationship to each other when said main legs are in a spread position;

said support leg being pivotally coupled to said main legs such that a lower end of said support leg is positionable in spaced relationship to said lower ends of said main legs when said main legs are in said spread position wherein said tripod assembly is adapted for resting on a support surface;

a carrying case for holding said tripod assembly when said tripod assembly is in a closed position, said closed position being defined by said main legs and said support leg being pivoted such that said lower ends of said main legs and said lower end of said support leg are positioned adjacent to each other;

said main legs being pivotally coupled together at a medial portion of each of said main legs, each main leg having an upper portion extending upwardly away from said medial portion such that said upper portions of said main legs form a generally V-shaped cradle portion when said main legs are in said spread position wherein said main legs are adapted for receiving and supporting a firearm between said upper portions of said main legs, each of said main legs further having a lower portion extending downwardly away from said medial portion;

a top portion of said support leg being pivotally coupled to one of said main legs at a position proximate a distal end of said support leg and below said medial portion where said main legs are pivotally coupled such that said distal end of said top portion is positionable horizontally below said cradle portion formed by said upper portions of said main legs when said main legs are in said spread position wherein said distal end is adapted for minimizing contact with the firearm when the firearm is supported in said cradle, said support leg having a lower portion extending downwardly from said top portion of said support leg;

said upper portion of each main leg being covered by a cushioning material wherein each of said upper portions is adapted for preventing damage to the firearm supported by said cradle portion;

a flexible line having a first end coupled to said lower portion of one of said main legs and a second end coupled to said lower portion of another of said main legs such that said flexible line extends between the lower portions of said main legs for preventing said lower ends of said main legs from spreading apart beyond a predetermined distance;

said carrying case being generally rectangular having an open top end, an elongated pair of sides, an elongated front, an elongated back, and a closed bottom end;

said carrying case including a flap extending from a back edge of said open top end, said flap being for extending over said open top end for covering said open top end;

said flap including a first connection member coupled to an interior face of said flap;

a second connection member coupled to an outer face of said elongated front of said carrying case, said second connection member being complimentary to said first connection member wherein said first connection member is selectively engageable to said second connection member wherein said flap is held in a covering position over said open top end to define a closed position of said carrying case;

a loop member coupled to an exterior face of said elongated back, said loop member being adapted for receiving a belt therethrough wherein said carrying case is adapted for coupling to a belt of a user;

said support leg having an upper end;

each of said main legs having an upper end; and a plurality of end caps, each end cap being positioned over an associated one of said main leg lower ends, said support leg lower end, said main leg upper ends, and said support leg upper end.

* * * * *